US006004447A

United States Patent [19]

Bischoping et al.

[11] Patent Number: 6,004,447

[45] Date of Patent: Dec. 21, 1999

[54] ELECTROFORMING PROCESS

[75] Inventors: Patricia Bischoping, Webster; Robert P. Altavela, Farmington; Lawrence Kotowicz, Rochester; Peter J. Schmitt, Ontario; William G. Herbert, Williamson, all of N.Y.; Ronald E. Jansen, Palm City, Fla.; John H. Lennon, Canandaigua, N.Y.; Henry G. Grey, Las Vegas, Nev.

[73] Assignee: Xerox Corporation, Stamford, Conn.

[21] Appl. No.: 08/446,145

[22] Filed: May 22, 1995

[51] Int. Cl.[6] ..... C25D 1/10

[52] U.S. Cl. ..... 205/50; 205/70; 205/73; 205/75; 205/67

[58] Field of Search ..... 205/67, 70, 73, 205/75

[56] References Cited

U.S. PATENT DOCUMENTS

| | | | |
|---|---|---|---|
| 3,464,898 | 9/1969 | Norris . | |
| 3,950,839 | 4/1976 | DuPree et al. | 29/447 |
| 4,473,516 | 9/1984 | Hunerberg . | |
| 4,627,894 | 12/1986 | Monnier . | |
| 4,664,758 | 5/1987 | Grey . | |
| 4,781,799 | 11/1988 | Herbert, Jr. et al. . | |
| 5,064,509 | 11/1991 | Melnyk et al. . | |
| 5,160,421 | 11/1992 | Melnyk et al. | 205/67 |
| 5,316,651 | 5/1994 | Herbert et al. | 205/67 |

*Primary Examiner*—Kathryn Gorgos
*Assistant Examiner*—Wesley A. Nicolas
*Attorney, Agent, or Firm*—Fay, Sharpe, Beall, Fagan, Minnich & McKee

[57] ABSTRACT

This invention relates to an electroforming device and a process used to electroform a metal layer on an inner surface of a female mandrel. The electrolytic solution flows only through an electrolytic solution passageway that defines the inner surface as the walls of the passageway. The mandrel may include more than one electrolytic solution passageway, or multiple mandrels may be used in a sequential order to mass produce the electroforms.

12 Claims, 3 Drawing Sheets

ELECTROFORMING PROCESS

BACKGROUND OF THE INVENTION

This invention relates to an electroforming apparatus and a process for using that apparatus to prepare an electroform, more specifically, the invention relates to a female mandrel with an interior fluid passageway for preparing electroforms therein when an electrolytic solution flows through the passageway while the mandrel is cathodic.

The fabrication of hollow, relatively thin articles from a metal by the process of electroforming is widely practiced in industry. Electroforms are used in many areas including printing, xerographing, and photocopying. Electroforms are also used in the printing of currency. One of the main advantages of the use of electroforms in printing type processes is the ability to produce many exactly identical copies. The quality and detail achieved with electroforming is superior to other techniques because of electroforming's ability to replicate exactly the design, or lack thereof, without any or with very minimal imperfections.

Basically, electroforming or electrodeposition is the process of depositing a substance, such as a metal, onto a conducting mold using electrical current. Electroforming processes known in the art submerse the conducting mold or mandrel into a bath of electrolytic solution through which a voltage drop exists.

The voltage drop results from connecting the mandrel to one terminal of a DC voltage source while a second terminal of the DC voltage source supplies the electrolytic solution with a current. The current flows through the conducting electrolytic solution from one terminal to the second terminal. This current flow involves a voltage drop, i.e., the voltage drop is the voltage developed across the electrolytic solution (conductor) during the flow of electrical current through the resistance of the electrolytic solution.

An electrolytic solution or electrolyte is a solution or other conducting medium in which electric current flows. The flow of electric current in the solution is caused by the migration of ions through the solution.

One of the early methods of electroforming is disclosed in U.S. Pat. No. 3,464,898. The outside surface of a plastic mandrel is coated with an electrically conductive material. The mandrel is then coupled to an electrode and immersed in an electrolytic or plating solution for electrodeposition. An electroform forms on the outside surface of the mandrel. The mandrel with an electroform thereon is removed from the plating solution and rinsed. The electroform is then separated from the mandrel by use of a solvent, or by heating and volatilizing the plastic material.

The following features, steps, and/or elements are present in some or all of the prior art electroforming devices and processes:

(1) the mandrel is immersed in a bath of electrolytic solution where both the inside and outside surface are in fluid contact with the bath;

(2) the working surface on the mandrel is typically an outer (male) surface, although U.S. Pat. No. 5,160,4241 discloses a female mandrel that is rotated and submersed into an electroforming bath to form an electroform;

(3) electroforming on a male surface requires compressive stresses;

(4) to create compressive stresses during electroforming, a sulfamic electrolyte such as sulfamate is used;

(5) the anode is soluble because insoluble anodes counteract with the sulfamic electrolyte thereby forming undesirable anode byproducts (but the sulfamic electrolytes are required to produce the necessary compressive stresses);

(6) soluble anodes solubilize thereby unequally changing (increasing) the distance between the cathode and the anode as the anode is consumed;

(7) the mandrel or anode is rotated while in the electrolytic solution to compensate for the inherent nonuniform anode to cathode distance resulting from the use of soluble anodes which cause the anode to cathode distance to change as the anode is consumed;

(8) coatings are needed on the mandrel to block deposition where deposition is not desired; and (9) to release the electroform from the male mandrel, one or more of the following three concepts are taken advantage of: (a) a difference in the thermal coefficients of expansion between the electroform and the mandrel; (b) the internal stress of the electroform; and (c) a hysteresis effect during cooling.

The thermal coefficient of expansion difference between the mandrel material and the electroform occurs on a male mandrel where the mandrel has a higher thermal coefficient of expansion, such as $13\times10^{-6}$ in./in.° F. for an aluminum mandrel, than that of the electroform, such as $8\times10^{-6}$ in./in.° F. for a nickel electroform, and where the internal stress of the electroform is not too tensile. The result from the mandrel having a higher thermal coefficient of expansion than the electroform is a larger decrease in the diameter of the mandrel than the decrease in the diameter of the electroform during cooling after the formation of the electroform. This larger diameter decrease by the mandrel compared to the electroform causes a gap to form between the electroform and the mandrel. The parting gap, if sufficiently large, will allow the electroform to slide off of the outside surface of the male mandrel.

Electroform internal stress control is useful in separation of the electroform from the mandrel, particularly with smaller electroforms. Internal stress control involves control of the internal stresses of the electroform to facilitate removal of the electroform. Electrolytic deposits naturally have tensile internal stresses; however, for an electroform to form on a male mandrel, compressive internal stresses rather than tensile internal stresses are required.

Using various techniques, including the use of additives such as saccharin in the electrolytic solution, compressive internal stresses are created. During electroforming on a male mandrel, i.e., plating of the male mandrel, one or more of the cation specics, for example $Ni^{+2}$, which are the electroform materials in the electrolytic solution are reduced and adhere to the mandrel, based upon the mandrel being sufficiently cathodic while the electrolytic solution is anodic, thereby forming the electroform. During cooling, cold shock occurs causing additional stress to be applied to the electroform. The result of this cold shock is the expansion of the electroform as it releases its bond with the mandrel and the electroform takes on a new size (slightly larger in the case of a compressively stressed electroform made on a male mandrel).

Hysteresis effect occurs where the hot male mandrel with an electroform therearound is cooled, such as in a cool water bath. The outside electroform will cool first for two reasons: (1) it is on the outside and in direct contact with the coolant, and (2) the electroform typically has a higher thermal conductivity than the mandrel, such as where the electroform is nickel and the mandrel is stainless steel. The result is the electroform wants to shrink before the mandrel. However, the mandrel is preventing the electroform from shrinking so the electroform must yield, i.e. stretch or expand. Then several seconds later, the mandrel cooling catches up and it shrinks. The electroform recovers some, but some hysteresis or residual stretching remains. The result is a parting gap between the faster shrinking electroform which was forced to stretch and the slower shrinking mandrel which eventually shrinks more.

The above mentioned features, steps, and/or elements of the prior art present a number of disadvantages, including but not limited to the following:

(1) the electrolytic solution tank in which the bath is given is open to receive the mandrel thereby allowing contaminants and impurities to freely enter the bath of electrolytic solution;

(2) unpleasent, noxious and/or harmful vapors and fumes are given off by the open tank of electrolytic solution;

(3) a large quantity of electrolytic solution is needed to submerse the entire mandrel therein;

(4) numerous working parts are needed to move the mandrel in and out of the electrolytic solution (i.e., a complex mechanical mechanism);

(5) in the male mandrel prior art, the working surface of the electroform is its outer surface, while the working surface of the mandrel upon which the electroform is formed is its outer surface, therefore the working surface of the electroform is not created on the working surface of the mandrel—as a result the working surface of the electroform does not have the controllable characteristics of the working surface of the mandrel; instead the inner, never used, surface of the electroform has these characteristics;

(6) compressive stresses as are necessary on a male mandrel require the use of certain electrolytic solutions such as sulfamate which must be vented due to the fumes, requires chemical additives, has a small stability temperature range, creates undesirable by products when used with insoluble anodes, and is expensive;

(7) the solubilization of the anode creates distance differences between the cathode and the anode;

(8) numerous working parts and connections such as electrical brushes are needed for the required rotation of either the anode or the cathode to offset the nonuniform anode to cathode distance;

(9) insoluble anodes counteract with the electrolytic solution thereby forming undesirable anode byproducts; and

(10) soluble anodes solubilize thereby changing (increasing) the distance between the cathode and the anode as the anode is consumed.

BRIEF SUMMARY OF THE INVENTION

The invention is an electroforming apparatus for preparing an electroform. The invention has a mandrel with an electrolytic fluid passageway extending through the mandrel. The invention also includes an anode positioned or insertable into the electrolytic fluid passageway and a supply of electrolytic solution fluidly connectable to the electrolytic fluid passageway.

The invention may also have regulating media passageways surrounding the electrolytic fluid passageway for flow of a temperature regulating media such as water or steam. The invention may be part of an electrolytic solution system which in addition to the mandrel, anode, and solution has a pump for moving electrolytic solution through the system, a filter for filtering out contaminants, and a heat exchanger for altering the temperature of the electrolytic solution.

In another embodiment, the mandrel has more than one electrolytic solution passageway for the simultaneous formation of multiple electroforms using just one mandrel.

It is an object of this invention to provide an electrodeposition system that does not require submersion of the entire mandrel into a bath.

It is an advantage of this invention to provide a process of forming an electroform where the entire mandrel is not immersed in an electrolytic solution.

It is a further advantage of this invention to provide a process and device for use therein for forming an electroform where the electrolysis does not occur in an open sump subject to contamination and impurities. Furthermore, it is an advantage to provide a closed system.

It is another advantage to provide a process and system where the electrolytic solution passes through the mandrel instead of immersing the mandrel therein. Furthermore, it is an advantage to eliminate or reduce the number of working parts required during the electroforming process.

It is yet another advantage to provide a mandrel where the working surface of the mandrel is the same surface as the working surface of the electroform formed thereon.

It is yet another advantage to provide a process capable of using the natural tensile stresses of the electrolytic solution during the electroforming process.

It is yet another advantage of this invention to provide a mandrel capable of producing more than one mandrel per electrolytic process.

Still other benefits and advantages of the invention will become apparent to those skilled in the art upon reading and understanding the following detailed specification.

BRIEF DESCRIPTION OF THE DRAWINGS

The invention may take physical form in certain parts and arrangements of parts, preferred and alternate embodiments of which will be described in detail in this specification and illustrated in the accompanying drawings which form a part hereof, and wherein.

DETAILED DESCRIPTION OF PREFERRED AND ALTERNATE EMBODIMENTS

Figure 1:
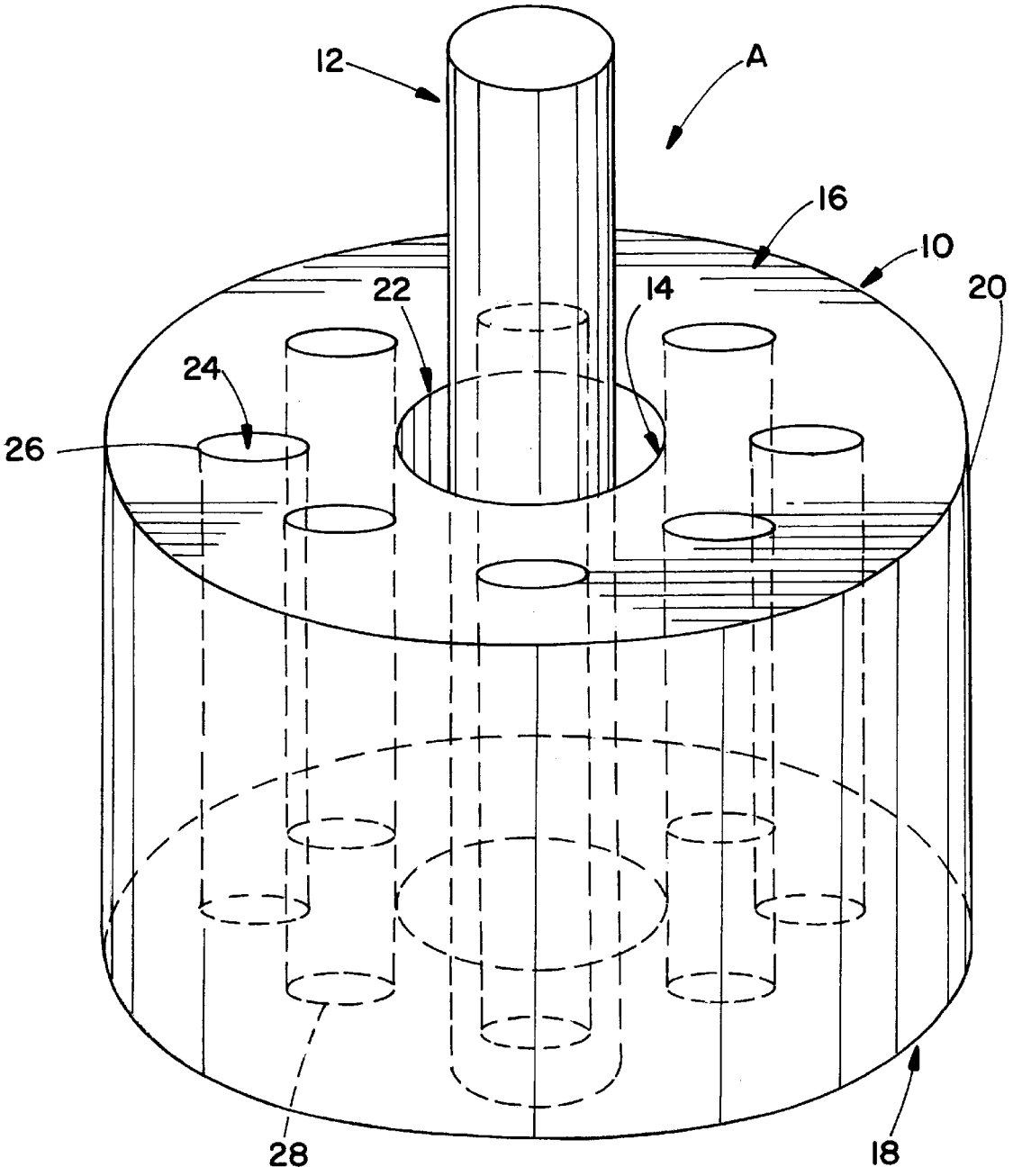
FIG. 1 shows a perspective view of one embodiment of a female, nonrotating mandrel.
Figure 2:
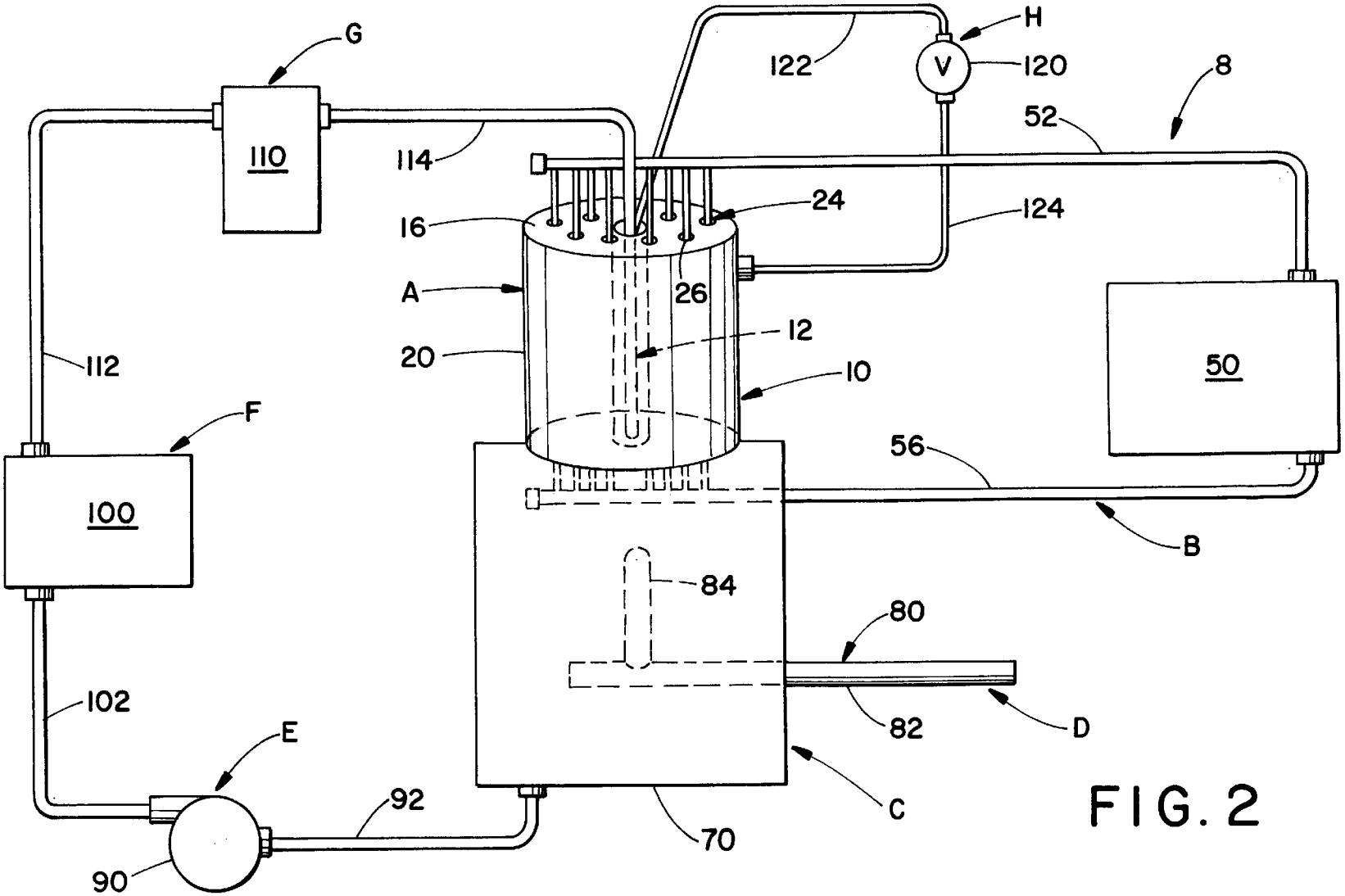
FIG. 2 shows a system for using the mandrel as shown in FIG. 1.
Figure 3:
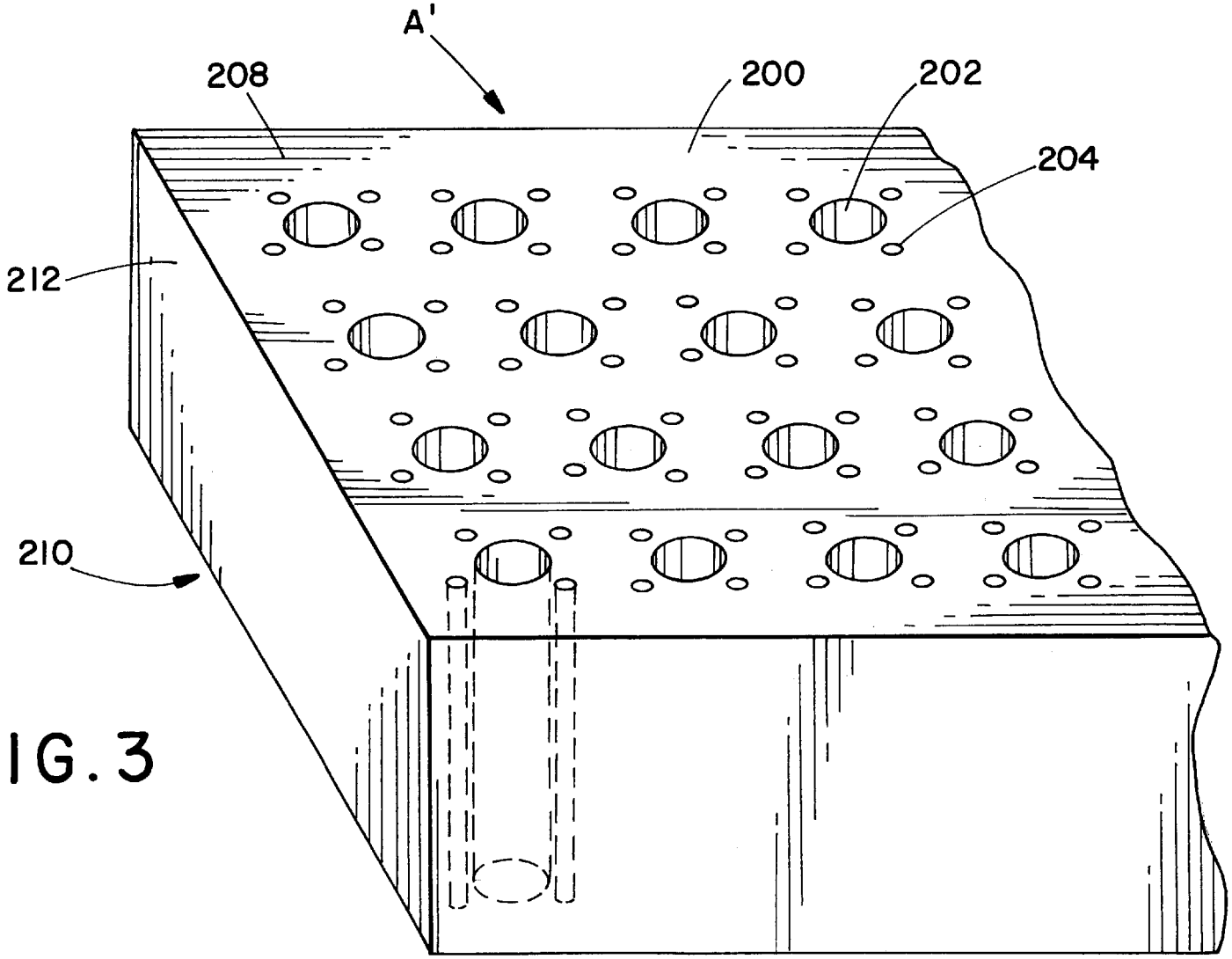
FIG. 3 is a perspective view of a second embodiment of a mandrel capable of simultaneously producing many electroforms all at once using a modification of the system in FIG. 2 with this mandrel.

Referring now to the drawings, wherein the showings are for purposes of illustrating preferred and alternate embodiments of the invention only and not for purposes of limiting same, FIGS. 1 and 2 show a first embodiment of an electroforming device. FIG. 3 shows a second embodiment capable of producing a plurality of electroforms simultaneously.

The Electroforming Device

FIG. 1 shows a perspective view of a first embodiment of the mandrel portion A for use in electroforming. Mandrel portion A includes a female mandrel 10 with an anode 12 inserted therein for use in with an electrolytic solution to form an electroformed metal layer on an inner surface 14 (electroforming surface) of female mandrel 10 thereby forming an electroform with a hollow interior.

In this embodiment, mandrel 10 is a metal cylinder with a top surface 16, a bottom surface 18, and an arcuate outer surface 20 extending therebetween. Mandrel 10 has an electroforming fluid passageway or duct 22 extending from the top surface 16 to the bottom surface 18 through which both electrolytic solution flows and anode 12 is positioned. Mandrel 10 is referred to as a female mandrel because the electroform is formed in electroforming fluid passageway 22 on electroforming surface 14.

In another embodiment, electroforming surface 14 may be coated by any of a number of methods such as electrodeposit, thermal fit, metal spray, or vacuum deposit with a conductive material for promoting electrical conduction and thereby promoting the formation of electrodeposits. In addition, the coating functions to not allow the electroform to adhere to the coated electroform surface 14. The coating material may be nickel, stainless steel, chromium, nickel alloys, or any other material known to be conductive and to deter adherence of the electroform on the electroforming surface 14.

Mandrel 10 includes a plurality of vent holes 24 for heating and cooling the mandrel. The vent holes allow a thermal regulating media such as water or steam to flow through the mandrel body thereby removing or adding heat to the mandrel. This embodiment has eight vent holes, with seven being visible. The vent holes 24 each have an upper opening 26 and a lower opening 28.

Mandrel 10 may be formed from substantially any metal including aluminum, zinc, cadmium, or lead. Electroforming surface 14 is coated in this embodiment with a layer of chromium. It is recognized by one skilled in the art that mandrel 10 may be made of any material and in any shape capable of withstanding the electroforming process and forming an electroform of the desired dimensions, properties, and quality. Further, it should be recognized that the electroforming surface may be coated with any of a number of coatings used in electroforming.

FIG. 2 is a system view of an electroforming system 8 comprising a number of subsystems including mandrel portion A, a mandrel heat exchanging system B, a solution recapture system C, an electroform handling system D, a solution pumping system E, a solution filtering system F, a solution heat exchanger G, and an electrical current supply H. The subsystems in which fluid flows, namely mandrel portion A, solution recapture system C, solution pumping system E, solution filtering system F, and solution heat exchanger system G, in combination are a closed system in that the electrolytic solution is not exposed to the atmosphere where contaminants can drop or drift into the solution.

The mandrel heat exchanger system B may be any type of heat exchanger system capable of controlling the temperature of the mandrel. In the subject embodiment, however, a heat exchanger 50 is fluidly connected to vents 24 by a first fluid pipe 52 with a plurality of branches where each of the branches is connected to one of the first openings 26, and a second fluid pipe 56 with a plurality of branches where each of the branches is connected to one of the second openings 28 (see FIG. 1). Heat exchanger 50 is capable of removing heat, i.e., cooling the liquid flowing through heat exchanger 50, its fluid pipes 52 and 56, the various branches thereof, and vents 24, when the mandrel temperature needs to be decreased; and supplying heat, i.e., heating the liquid through heat exchanger 50, its fluid pipes 52 and 56, the various branches thereof, and vents 24, when the mandrel temperature needs to be increased.

Solution recapture system C in the embodiment shown in FIG. 2 is a solution sump 70 for collecting the electrolytic solution after the solution has passed through electroforming fluid passageway 22 and funneling the solution into solution pumping system E for reuse in electroforming solution passageway 22 via the passageway opening in top surface 16 of mandrel 10. Sump 70 is connected to mandrel 10 in a sealed manner so that contaminants cannot enter the system and so that all of the electrolytic solution that passes through the electroforming solution passageway 22 is recaptured. It is recognized that solution recapture system C may be any mechanism capable of connection to an exit opening from electroforming solution passageway 22 so as to keep all of the exiting solution within the electroforming system 8. One such mechanism could be a funnel attached to bottom surface 18 in a sealed manner.

In this embodiment, electroform handling system D includes an electroform handler 80 for receiving the electroform after its formation in the electroforming solution passageway 22 and removing it from the electroforming system 8. Electroform handler 80 has a handle or base 82 and an electroform receiver 84. The electroform handler 80 is movable in all three axial directions to insure proper positioning of receiver 84 under the electroform as well as to allow the electroform to be removed from sump 70. It is recognized by anyone skilled in the art that electroform handling system D may be any mechanism capable of receiving an electroform and removing the electroform from the mandrel 10 and the area below the mandrel such as the solution sump 70 where the electroform falls to after the electroform is separated from the electroforming surface 14 of the mandrel 10.

Solution pumping system E is any pumping mechanism capable of recirculating the electrolytic solution through the closed electroforming solution flowing portion of electroforming system 8, namely from solution pumping system E to solution filtering system F to solution heat exchanger G through electroforming solution passageway 22 in mandrel portion A to solution recapture system C and back to solution pumping system E. Solution pumping system E includes a pump 90 that is fluidly connected in a sealed manner by fluid conduit 92 to solution sump 70.

Solution filtering system F is any filtering mechanism capable of filtering out contaminants and other materials that might disrupt the quality of the electroforming process. Solution filtering system F includes a filter 100 that is fluidly connected in a sealed manner by fluid conduit 102 to pump 90.

Solution heat exchanger G functions to control the temperature of the electrolytic solution and maintain the temperature of the solution in a normal desired range. During the electroforming process, it is necessary for solution heat exchanger G to remove heat from the system because there is amperage running between the anode and the cathode, sometimes thousands of amps, creating heat because of the resistance in the system. When electroforming is not occurring, it is necessary for the solution heat exchanger G to heat the electrolytic solution to maintain it at a certain minimum temperature that is typically above room temperature. If the electrolytic solution falls below the minimum temperature, some of the solution will precipitate out thereby disabling the electroforming process.

While many types of heat exchanger systems could be used, in the preferred embodiment, solution heat exchanger G includes a heat exchange unit 110 that is connected in a sealed manner by fluid conduit 112 to filter 100, and that is fluidly connected in a sealed manner by fluid conduit 114 to electrolytic solution passageway 22 in mandrel 10.

Electrical current supply H is a DC source 120 having a positive lead 122 and a negative lead 124. The positive lead 122 is electrically connected to anode 12. The negative lead 124 is electrically connected to mandrel 10 which is functioning as a cathode. Anode 12 is positioned in electroforming solution passageway 22 which is a bore or duct extending through mandrel 10.

The electrolytic solution flowing through electroforming solution passageway 22 acts as a conductor and conducts an electric current that may measure thousands of amps from the DC source through the anode 12, the electrolytic solution, and the cathode/mandrel 10, and back to the DC source. It is this current running through the electrolytic solution that forms the electroform metal layer on the electroforming surface 14 in the mandrel.

It is also contemplated that the electrolytic solution flow could be reversed where the solution is pumped up through electrolytic solution passageway 22 instead of gravitationally falling through passageway 22 and being pumped back up to the top surface 16 of the mandrel 10.

A pH tester may be supplied in the closed fluid system allowing the testing and monitoring of the pH of the electrolytic solution so that the pH may be adjusted to keep it within a normal range.

FIG. 3 shows a perspective view of another embodiment of the mandrel portion, in this case A', for use in electroforming. Mandrel portion A' includes more than one electroforming solution passageway thereby allowing more than one electroform to be produced simultaneously.

More specifically, mandrel portion A' includes a mandrel 200 with a plurality of electroforming solution passageways 202, i.e., a plurally female mandrel. Around each of the electroforming solution passageways 202 is a plurality of vent holes 204. An anode is insertable into each electroforming solution passageway 202 for use in with an electrolytic solution to form an electroformed metal layer on an inner surface 206 (electroforming surface) of each electroforming solution passageway thereby forming an electroform with a hollow interior.

In this embodiment, mandrel 200 is a metal block with a top surface 208, a bottom surface 210, and an outer surface 212 extending therebetween. Mandrel 200 has a plurality of electroforming solution passageways 202 extending from the top surface 208 to the bottom surface 210 through which both electrolytic solution flows and an anode is positioned. Mandrel 200 is a female mandrel because the electroform is formed in electroforming fluid passageways 202 on electroforming surface 206.

It is contemplated that mandrel 200 will be combined in a system comprising a number of subsystems including mandrel portion A', a mandrel heat exchanging system, a solution recapture system, an electroform handling system, a solution pumping system, a solution filtering system, a solution heat exchanger, and an electrical current supply. The subsystems in which fluid flows are in combination a closed system in that the electrolytic solution is not exposed to the atmosphere where contaminants can drop or drift into the solution. As would be understandable to one skilled in the art, these subsystems will be similar to subsystems B-H described above as modified to account for multiple electrolytic solution passageways.

The Electroforming Process Using Mandrel 10

To prepare an electroform using mandrel 10 as described above, electrolytic solution must be supplied to mandrel 10 via one of the ends of electrolytic solution passageway 22. An anode 12 connected to a DC source must also be present within electrolytic solution passageway 22.

After the electrolytic solution is flowing through the passageway 22, the mandrel is made cathodic by running an electrical current from the DC source into mandrel 10. The electrical current is adjusted to a desired level. The electric current flowing from the anode 12 to the mandrel/cathode 10 creates a voltage drop in the electrolytic solution because although the electrolytic solution is conductive, it has some resistance resulting in the voltage drop.

After a specified period of time required to obtain an electroform of the desired thickness, the current into the mandrel is terminated and the electrolyte flow is terminated. The electroform is then removed from the electroform surface 14 of the mandrel by any means of parting an electroform from a female mandrel including those described below.

The Electroforming Process Using Electroforming System 8

To prepare an electroform in electroforming system 8 as described above, electrolytic solution must be supplied to the system such as in sump 70. If anode 12 is not already positioned in electroforming solution passageway 22, then anode 12 must be positioned therein.

Pump 90 is actuated resulting in a filtered electrolyte stream flowing through the electroforming solution passageway 22 at a selected speed (for instance, an acceptable speed is 3 gallons per minute (gpm) for 150 amps per sq. ft. (ASF) using a ¼" diameter carbon anode and electroforming a 1" diameter by 16" long part). The speed must be sufficient to allow both high current density and the removal of all harmful anode byproducts if any exist.

After the electrolytic solution is flowing through the passageway 22, the mandrel is made cathodic by running an electrical current from DC source 120 into mandrel 10. The electrical current is adjusted to a desired level. The electric current flowing from the anode 12 to the mandrel/cathode 10 creates a voltage drop in the electrolytic solution because although the electrolytic solution is conductive, it has some resistance which creates the voltage drop.

After a specified period of time required to obtain an electroform of the desired thickness, the current into the mandrel is terminated and the electrolyte flow is terminated. The electroform is then removed from the electroform surface 14 of the mandrel by a parting step.

This parting step for a female mandrel 10 differs from the parting of the prior art for male mandrels. The same three concepts are used, but in different manners. To release the electroform from the female mandrel 12, opposite actions must occur such as heating during both thermal differences and hysteresis instead of cooling as is used in the male mandrel situation. However, typically thermal coefficient of expansion difference and internal stress control are used to part an electroform from a female mandrel.

The thermal coefficient of expansion difference between the mandrel material and the electroform occurs on a female mandrel in a different manner than on a male mandrel as described above. Instead of cooling the mandrel and electroform where the mandrel has a higher thermal coefficient of expansion, such as $13\times10^{-6}$ in./in.° F. for an aluminum mandrel, than that of the electroform, such as $8\times10^{-6}$ in./in.° F. for a nickel electroform, as was done with a male mandrel, the mandrel and electroform are heated resulting in the mandrel with the higher thermal coefficient of expansion in comparison to the electroform having a larger increase in diameter. This larger diameter increase by the mandrel compared to the electroform causes a gap to form between the electroform and the mandrel. The parting gap, if sufficiently large, will allow the electroform to slide off of the inside surface of the female mandrel.

As stated in the background, electroform internal stress control is useful in separation of the electroform from the mandrel, particularly with smaller electroforms. Internal stress control involves control of the internal stresses of the electroform to facilitate removal of the electroform. Electrolytic deposits naturally have tensile internal stresses and these natural tensile internal stresses are useful during parting when using a female mandrel.

During electroforming of a female mandrel, i.e., plating of the inner surface of the female mandrel, the electroform materials in the electrolytic solution stick to the inner surface of the mandrel, based upon the mandrel being cathodic while the electrolytic solution is anodic, thereby forming the electroform. During cooling, cold shock occurs causing additional stress to be applied to the electroform. The result of this cold shock is the contraction of the electroform as it snaps, cracks, an/or pops as its bond with the mandrel is broken and the electroform takes on a new size (slightly smaller in the case of a female mandrel under tensile stresses).

If hysteresis is used to part the electroform from the mandrel it would be preferably done in two steps. First, the electroform only is heated by for example passing steam through it. Step two involves heating both the electroform and the mandrel creating a parting gap. The electroform in step one heats first since it has lower mass and it is adjacent to the heat source thereby resulting in the electroform wanting to expand but the mandrel prevents it causing the electroform to yeild. The heating of both mandrel and electroform in step two causes the mandrel to expand resulting in the electroform then recoving some (i.e., enlarging some) but retaining some yielding. The result is a parting gap between the faster enlarging, but initially restricted, electroform and the slower enlarging mandrel.

The Electroforming Process In An Assembly Line Format

An electroforming process using a mandrel 200 with a plurality of electrolytic solution passageways 202 can produce a plurality of electroforms simultaneously by performing the previously described process in electroforming system 8. An example of such a system is shown in FIG. 3.

An alternative electroforming process involves forming electroforms along an assembly line, around a carousel, or in a similar sequential fashion. Such a sequential process requires an assembly line, a carousel, or a similar sequential mechanism with a plurality of mandrels thereon, where each mandrel has a cylindrical hollow chamber with an electroforming surface therein.

In one embodiment of this alternative electroforming process, the process is a carousel with a plurality of electroforming stations. These stations include (a) a preheating station, (b) an electrodeposition station, (c) a parting station, and (d) a cleaning station. Several other systems are interconnected to these stations including a mandrel heat exchanging system connected to the preheating station and the parting station, an electroform handling system connected to the parting station, and the following systems that are interconnected to each other and connected to the electrodeposition station: a solution recapture system, a solution pumping system, a solution filtering system, a solution heat exchanger, and an electrical current supply.

The process starts by preheating, if necessary, the first mandrel. After the first mandrel is within a reasonable operating temperature range, the first mandrel is moved to the electrodeposition station where the electrolytic solution passageway is aligned to receive a stream of electrolytic solution. Preferably, this step is part of a closed system where the electrolytic solution remains within the closed system thereby preventing impurities and contaminants from entering the solution. In addition, an anode must be inserted into the electrolytic solution passageway.

A filtered electrolyte stream is then initiated and it flows through the electrolytic solution passageway at a speed sufficient to allow both high current density and removal of all harmful anode byproducts. An example of such a speed is 3 gallons per minute (gpm) for 150 amps per sq. ft. (ASF) using a ¼" diameter carbon anode and electroforming a 1" diameter by 16" long part. Once electrolytic solution is flowing through the electrolytic solution passageway, the mandrel must be made cathodic which is accomplished by initiating an electric current from a DC power source that flows from the anode to the mandrel creating a voltage drop in the electrolytic solution because, although the electrolytic solution is conductive, it has some resistance resulting in a voltage drop. The electrical (DC) current into the mandrel must be adjusted to a desired level for forming an electroform of a desired thickness.

After a specified period of time required to obtain an electroform of the desired thickness, the current into the mandrel is terminated. The electrolytic solution flow is also terminated. The anode is removed from the electrolytic solution passageway in the mandrel. The mandrel is then freed of the electrolyte feed mechanism at the electrodeposition station.

The mandrel with an electroform therein is moved from the electrodeposition station to the parting station. Simultaneously with this movement, the electrodeposition channel may be rinsed prior to the second mandrel moving into place at the electrodeposition station from the preheating station, if necessary.

At the parting station, the electroform is removed from the electroform surface 14 of the mandrel. The removal is based upon a combination of three concepts discussed above, namely (a) thermal coefficient of expansion differences between the electroform and the mandrel while the mandrel is heated if a female mandrel (or cooled if a male mandrel); (b) internal stress control; and (c) hysteresis by the electroform as the electroform and mandrel are cooled.

After the electroform becomes free from the electroform surface in the electrolytic solution passageway and drops out of the electrolytic solution passageway, it is collected and moved out of the system. The first mandrel is then moved to a cleaning station, while the second mandrel is moved to the parting station, and a third mandrel moves to the electrodeposition station.

The process is started all over again when the first mandrel is moved to the preheating station. It is contemplated that additional stations may be added such as a cooling station in between the electrodeposition station and the parting station instead of cooling occurring at the parting station.

The electrolyte solution used to create the electroform is cleaned and/or treated for reuse in an external treatment area that is part of the solution filtering system.

EXAMPLES

The following are examples of electrolytic solutions used in the specified mandrels under the specified operating parameters. All are examples of electroforms formed by mandrel. These examples are not meant to limit this disclosure in any way, in contrast these examples are meant to show one or more of the many electroforming solutions and cathode-anode properties usable with the above disclosed process and mandrel with a duct therein.

BATH EXAMPLE 1
SULFAMATE NICKEL

| | PREFERRED | MOST PREFERRED |
|---|---|---|
| MAJOR ELECTROLYTE CONSTITUENTS: | | |
| Nickel Sulfamate: (as $Ni^{+2}$) | 8–16 oz/gal. (60–120 g/L) | 11.5 oz/gal. |
| Chloride: (as $NiCl_2$ $6H_2O$) | 0–1 oz/gal. (0–7.5 g/L) | 0.5 oz/gal. |
| Boric Acid: | 5.0–5.4 oz/gal. (37.5–40.5 g/L) | 5 oz/gal. |
| pH: (at 23° C.) | 3.85–4.05 | 3.95 |
| Surface Tension: (at 136° F.) | 32–37 d/cm (See Note 1) | 35 d/cm. |
| Saccharin: | 0–30 mg/L (See Note 2) | 0 mg/L. |
| Lever: | 0–150 mg/L (See Note 3) | 0 mg/L. |
| IMPURITIES: | | |
| Aluminum: | 0–20 mg/L. | 0 mg/L. |
| Ammonia: | 0–400 mg/L. | 0 mg/L. |
| Arsenic: | 0–10 mg/L. | 0 mg/L. |
| Azodisulfonate: | 0–50 mg/L. | 0 mg/L. |
| Cadmium: | 0–10 mg/L. | 0 mg/L. |
| Calcium: | 0–20 mg/L. | 0 mg/L. |
| Hexavalent Chromium: | 4 mg/L max. | 0 mg/L. |
| Copper: | 0–25 mg/L. | 0 mg/L. |
| Iron: | 0–250 mg/L. | 0 mg/L. |
| Lead: | 0–8 mg/L. | 0 mg/L. |
| MBSA: (2–Methyl Benzene Sulfonamide) | 0–2 mg/L. | 0 mg/L. |
| Nitrate: | 0–10 mg/L. | 0 mg/L. |
| Organics: (See Note 4) | minimal | 0 mg/L. |
| Phosphates: | 0–10 mg/L. | 0 mg/L. |
| Silicates: | 0–10 mg/L. | 0 mg/L. |
| Sodium: | 0–0.5 mg/L. | 0 mg/L. |
| Sulfate: | 0–2.5 g/L. | 0 mg/L. |
| Zinc: | 0–5 mg/L. | 0 mg/L. |
| OPERATING PARAMETERS: | | |
| Agitation Rate: (See Note 5) | 4–10 linear ft/sec | 10 linear ft/sec. |
| Cathode (Mandrel): Current Density | 50–800 amps/sq. ft. (ASF) | 350 ASF |
| Ramp Rise: (0 to operating amps in) | 0 to 15 min. ± 2 sec. | 0.1 min |
| Plating Temperature at Equilibrium: | 130–155° F. | 140° F. |
| Anode: | Electrolytic, Depolarized, Carbonyl Nickel, Platium, Carbon, Pd/Ti alloy | Pd/Ti alloy |
| Anode to Cathode Ratio: | 0.5–0.9:1 | 0.9:1 |
| Mandrel Core: | Aluminum, Zinc, Lead Cadmium | Aluminum |
| Mandrel Surface: | Stainless Steel, Chromium, Nickel, Nickel Alloys | Chromium |

NOTES:
Note 1: Surface tension using Sodium Lauryl Sulfate (about 0.00525 g/l)
Note 2: Saccharin = 0–30 mg/L as Sodium Benzosulfimide dihydrate
Note 3: Lever as 2-butyne 1,4-diol.
Note 4: Depends on the type, however, all known types need to be minimized.
Note 5: agitation rate = linear ft/sec. of solution flow over the cathode surface

BATH EXAMPLE 2
SULFATE NICKEL

| | PREFERRED | MOST PREFERRED |
|---|---|---|
| MAJOR ELECTROLYTE CONSTITUENTS: | | |
| Nickel Sulfate: (as $Ni^{+2}$) | 8–12 oz/gal. (60–90 g/L) | 10 oz/gal. |
| Chloride: (as $NiCl_2$ $6H_2O$) | 0–1 oz/gal. (0–7.5 g/L) | 0 oz/gal. |
| Boric Acid: | 5.0–5.4 oz/gal. (37.5–40.5 g/L) | 5 oz/gal. |
| pH: (at 23° C.) | 3.85–4.15 | 4.00 |
| Surface Tension: (at 136° F.) | 32–37 d/cm (See Note 1) | 35 d/cm. |

-continued

BATH EXAMPLE 2
SULFATE NICKEL

| | PREFERRED | MOST PREFERRED |
|---|---|---|
| IMPURITIES: | | |
| Aluminum: | 0–20 mg/L. | 0 mg/L. |
| Ammonia: | 0–400 mg/L. | 0 mg/L. |
| Arsenic: | 0–10 mg/L. | 0 mg/L. |
| Azodisulfonate: | 0–50 mg/L | 0 mg/L. |
| Cadmium: | 0–10 mg/L. | 0 mg/L. |
| Calcium: | 0–20 mg/L. | 0 mg/L. |
| Hexavalent Chromium: | 4 mg/L max. | 0 mg/L. |
| Copper: | 0–25 mg/L. | 0 mg/L. |
| Iron: | 0–250 mg/L. | 0 mg/L. |
| Lead: | 0–8 mg/L. | 0 mg/L. |
| MBSA: (2-Methyl Benzene Sulfonamide) | 0–2 mg/L. | 0 mg/L. |
| Nitrate: | 0–10 mg/L. | 0 mg/L. |
| Organics: (See Note 2) | minimal | 0 mg/L. |
| Phosphates: | 0–10 mg/L. | 0 mg/L. |
| Silicates: | 0–10 mg/L. | 0 mg/L. |
| Sodium: | 0–0.5 mg/L. | 0 mg/L. |
| Sulfate: | 0–2.5 mg/L. | 0 mg/L. |
| Zinc: | 0–5 mg/L. | 0 mg/L. |
| OPERATING PARAMETERS: | | |
| Agitation Rate: (See Note 3) | 4–10 linear ft/sec. | 10 linear ft/sec. |
| Cathode (Mandrel): Current Density | 50–250 ASF | 200 ASF |
| Ramp Rise: (0 to operating amps in) | 0 to 15 min. ± 2 sec. | 0.1 min. |
| Plating Temperature at Equilibrium: | 130–155° F. | 140° F. |
| Anode: | Electrolytic, Depolarized, Carbonyl Nickel, Platium, Carbon, Pd/Ti alloy. | Pd/Ti alloy |
| Anode to Cathode Ratio: | 0.5–0.9:1 | 0.9:1 |
| Mandrel Core: | Aluminum, Zinc, Lead Cadmium | Aluminum |
| Mandrel Surface: | Stainless Steel, Chromium, Nickel, Nickel Alloys | Chromium |

NOTES:
Note 1: Surface tension using Sodium Lauryl Sulfate (about 0.00525 g/l)
Note 2: Depends on the type, however, all known types need to be minimized.
Note 3: agitation rate = linear ft/sec. of solution flow over the cathode surface

BATH EXAMPLE 3
SULFATE COPPER

| | PREFERRED | MOST PREFERRED |
|---|---|---|
| MAJOR ELECTROLYTE CONSTITUENTS: | | |
| Copper Sulfate: | 30–32 oz/gal. (225–240 g/L) | 32 oz/gal. |
| Sulfuric Acid: | 6–10 oz/gal. (45–75 g/L) | 60 oz/gal. |
| IMPURITIES: | | |
| Aluminum: | 0–20 mg/L. | 0 mg/L. |
| Ammonia: | 0–400 mg/L. | 0 mg/L. |
| Arsenic: | 0–10 mg/L. | 0 mg/L. |
| Azodisulfonate: | 0–50 mg/L. | 0 mg/L. |
| Cadmium: | 0–10 mg/L. | 0 mg/L. |
| Calcium: | 0–20 mg/L. | 0 mg/L. |
| Hexavalent Chromium: | 4 mg/L max. | 0 mg/L. |
| Nickel: | 0–250 mg/L. | 0 mg/L. |
| Iron: | 0–250 mg/L. | 0 mg/L. |
| Lead: | 0–8 mg/L. | 0 mg/L. |
| MBSA: (2–Methyl Benzene Sulfonamide) | 0–2 mg/L. | 0 mg/L. |
| Nitrate: | 0–10 mg/L. | 0 mg/L. |
| Organics: (See Note 1) | minimal | 0 mg/L. |
| Phosphates: | 0–10 mg/L. | 0 mg/L. |
| Silicates: | 0–10 mg/L. | 0 mg/L. |
| Sodium: | 0–0.5 mg/L. | 0 mg/L. |
| Sulfate: | 0–2.5 mg/L. | 0 mg/L. |
| Zinc: | 0–5 mg/L. | 0 mg/L. |

-continued

| BATH EXAMPLE 3 SULFATE COPPER | PREFERRED | MOST PREFERRED |
|---|---|---|
| OPERATING PARAMETERS: | | |
| Agitation Rate: (See Note 2) | 4–10 linear ft/sec. | 10 Linear ft/sec. |
| Cathode (Mandrel): Current Density | 30–150 ASF | 100 ASF |
| Ramp Rise: (0 to operating amps in) | 0 to 15 min. ± 2 sec. | 0.1 min. |
| Plating Temperature at Equilibrium: | 80–110° F. | 110° F. |
| Anode: | Platium, Carbon, Pd/Ti alloy | Pd/Ti alloy |
| Anode to Cathode Ratio: | 0.5–0.9:1 | 0.9:1. |
| Mandrel Core: | Aluminum, Zinc, Lead Cadmium | Aluminum |
| Mandrel Surface: | Stainless Steel, Chromium, Nickel, Nickel Alloys | Chromium. |

NOTES:
Note 1: Depends on the type, however, all known types need to be minimized.
Note 2: agitation rate = linear ft/sec. of solution flow over the cathode surface The invention has been described with reference to preferred and alternate embodiments. Obviously, modifications and alterations will occur to others upon the reading and understanding of this specification. It is intended to include all such modifications and alterations insofar as they come within the scope of the appended claims or the equivalents thereof.

Having thus described the preferred and alternative embodiments, the invention is claimed as follows:

1. A process of preparing an electroform, comprising the steps of:

electroforming a layer of material on an inner surface of a duct extending through a mandrel, thereby forming an electroform with a hollow interior; and removing the electroform from the mandrel.

2. The process in claim 1 wherein the duct has an entrance port and an exit port.

3. The process in claim 2 wherein the electroforming step comprises the substeps of:

providing electrolytic solution in the duct that flows from the entrance port to the exit port; and supplying a voltage between an anode and the mandrel thereby forming the electroform on the inner surface of the duct.

4. The process in claim 3 wherein the electrolytic solution is selected from the group consisting of nickel sulfate, copper sulfate, and nickel sulfamate.

5. The process in claim 3 wherein the electrolytic solution is stable up to its boiling point and produces tensile stresses.

6. The process in claim 1 wherein the mandrel includes at least one temperature regulating means.

7. The process in claim 3 wherein the anode is both inserted into the duct and fixed within the duct relative to the mandrel during the supplying of said voltage.

8. The process in claim 3 further comprising a closed electrolytic solution system comprising:

a pump for moving electrolytic solution through the closed system;

a filter for filtering out contaminants; and at least one heat exchanger for altering the temperature of the electrolytic solution.

9. The process in claim 8 wherein the closed electrolytic solution system includes a pH tester.

10. The process in claim 1 wherein the anode is an insoluble anode.

11. An electroform prepared by a process comprising the steps of:

electroforming a layer of metal on an inner surface of a mandrel having a duct therein, thereby forming an electroform with a hollow interior; and removing the electroform from the mandrel.

12. The electroform of claim 11 is formed from an electrolytic solution that is selected from the group consisting of nickel sulfate, copper sulfate, and nickel sulfamate.

* * * * *